US010957989B2

(12) United States Patent
Catalani et al.

(10) Patent No.: US 10,957,989 B2
(45) Date of Patent: Mar. 23, 2021

(54) DIRECTIONAL WAVEGUIDE COUPLER, BEAMFORMING NETWORK, AND ANTENNA ARRAY COMPRISING SAID COUPLER

(71) Applicant: AIRBUS ITALIA S.P.A., Rome (IT)

(72) Inventors: Alfredo Catalani, Rome (IT); Fabio Maggio, Rome (IT); Vincenzo Pascale, Rome (IT); Piero Angeletti, Rome (IT); Giovanni Toso, Rome (IT); Daniele Petrolati, Rome (IT)

(73) Assignee: AIRBUS ITALIA S.P.A., Rome (IT)

( * ) Notice: Subject to any disclaimer, the term of this patent is extended or adjusted under 35 U.S.C. 154(b) by 0 days.

(21) Appl. No.: 16/552,173

(22) Filed: Aug. 27, 2019

(65) Prior Publication Data

US 2020/0076091 A1 Mar. 5, 2020

(30) Foreign Application Priority Data

Aug. 28, 2018 (IT) ..... 102018000008200

(51) Int. Cl.

| | |
|---|---|
| ***H01Q 13/00*** | (2006.01) |
| ***H01Q 21/06*** | (2006.01) |
| ***H01Q 13/06*** | (2006.01) |
| ***H01Q 13/02*** | (2006.01) |

(52) U.S. Cl.

CPC ..... *H01Q 21/064* (2013.01); *H01Q 13/00* (2013.01); *H01Q 13/02* (2013.01); *H01Q 13/06* (2013.01)

(58) Field of Classification Search

CPC ..... H01Q 13/00; H01Q 13/02

See application file for complete search history.

(56) References Cited

U.S. PATENT DOCUMENTS 2,568,090 A * 9/1951 Riblet ..... H03D 7/1408 455/328
2,585,173 A * 2/1952 Riblet ..... H01Q 25/02 333/113
3,063,025 A * 11/1962 Atta ..... G01S 13/4409 333/137
5,105,170 A * 4/1992 Joshi ..... H01P 5/16 330/295

(Continued)

OTHER PUBLICATIONS

Italian Search Report for Italian Patent Application No. 201800008200 dated May 7, 2019, 9 pages.

(Continued)

*Primary Examiner* — Vibol Tan
(74) *Attorney, Agent, or Firm* — Merchant & Gould P.C.

(57) ABSTRACT

A directional waveguide coupler (20) has four input ports and four output ports. Each input port is coupled to each of the output ports. The directional coupler (20) includes a first coupler having two waveguides (W1, W2) coupled to each other by a first slot array (S1), defined in a first wall (21) common to the two waveguides (W1, W2) of the first coupler. A second coupler has two waveguides (W3, W4), coupled to each other by a second slot array (S2), defined in a second wall (22) common to the two waveguides (W3, W4) of the second coupler. The first and second slot arrays (S1, S2) lie on a first common plane. The first and second couplers are coupled to each other by a third slot array (S3) and a fourth slot array (S4), which lie on a second common plane perpendicular to the first common plane.

15 Claims, 9 Drawing Sheets

(56) References Cited

U.S. PATENT DOCUMENTS

| | | | | |
|---|---|---|---|---|
| 6,411,174 | B1 * | 6/2002 | Crouch | H01P 5/12 333/125 |
| 7,259,640 | B2 * | 8/2007 | Brown | B33Y 10/00 333/160 |
| 9,640,851 | B2 * | 5/2017 | Nantista | H01P 1/165 |
| 9,923,258 | B2 * | 3/2018 | Fahmi | H01P 5/12 |
| 2015/0341098 | A1 | 11/2015 | Angeletti et al. | |

OTHER PUBLICATIONS

Alessandri, F. et al., "A New Class of Dual-Mode Directional Couplers for Compact Dual-Polarization Beam-Forming Networks", IEEE Microwave and Guided Wave Letters, 7(9): 300-301 (Sep. 1997).

Longhi, M. et al., "Dual-polarization beam forming networks based on high oder directional couplers", 2017 11th European Conference on Antennas and Propagation (EUCAP), 2820-2823 (Mar. 2017).

Mailloux, R., "Phased Array Antenna Handbook", 2nd edition, Artech House Publishing Co., 515 pages (2000).

Skobelev, S., "Analysis and Synthesis of an Antenna Array with Sectoral Partial Radiatioin Patterns", Telecommunications and Radio Engineering, 45: 116-119 (Nov. 1990).

Skobelev, S., "Methods of Constructing Optimum Phased-Array Antennas for Limited Field of View", IEEE Antennas and Propagation Magazine, 40(2): 39-49 (Apr. 1998).

Skobelev, S., "Phased Array Antennas With Optimized Element Patterns", Artech House Publishing, 285 pages (2011).

Skobelev, S. et al., "Some features of shaping narrow flat-topped radiation patterns by overlapped subarrays in limited scan waveguide phased array antennas", 2017 11th European Conference on Antennas and Propagation (EUCAP), 1101-1105 (Mar. 2017).

* cited by examiner

DIRECTIONAL WAVEGUIDE COUPLER, BEAMFORMING NETWORK, AND ANTENNA ARRAY COMPRISING SAID COUPLER

This application claims benefit of Serial No. 102018000008200, filed 28 Aug. 2018 in Italy and which application is incorporated herein by reference. To the extent appropriate, a claim of priority is made to the above disclosed application.

BACKGROUND OF THE INVENTION

The present invention relates to the technical field of telecommunications, and in particular relates to a directional waveguide coupler and a beamforming network. The present invention also relates to an antenna array comprising said directional coupler.

The present invention is applied by way of non-limiting example to transmitting or receiving antenna arrays which can be used in satellites.

As known, overlapped subarray antennas (OSA in short), intended both as direct radiation antennas and as indirection radiation antennas, are characterized by a significant reduction of the number of control elements (amplifiers, variable attenuators and phase shifters) with respect to conventional active array antennas. With respect to active array antennas, the complexity reduction factor may be quantified as the ratio of the number of radiant elements in traditional configuration to the number of subarrays.

OSAs require a waveguide beamforming network to conveniently connect the antenna elements to the antenna input or output port, according to whether the antenna is used as transmitting or receiving antenna, respectively.

The Documents

R. J. Mailloux, Phased Array Antenna Handbook, 2nd edition, Dedham, M A, Artech House Publishing Co., 2000:

S. P. Skobelev, "Phased Array Antennas With Optimized Element Patterns", Dedham, M A, Artech House Publishing Co., 2011;

S. P. Skobelev, "Methods of constructing optimum phased-array antennas for limited field of view", IEEE Antennas Propagation Magazine, Vol. 40, No. 2, pp. 39-49, April 1998;

describe a rather complete panorama of OSA techniques and beamforming networks.

The publication by S. P. Skobelev, "Analysis and Synthesis of an Antenna Array with Sectoral Partial Radiation Patterns", Telecommunications and Radio Engineering, 45, November 1990, pp. 116-119 describes a beamforming network without losses, consisting of power dividers and directional couplers, which coupling coefficients may be obtained by an optimization process. The beamforming network described in this publication, also called "checkerboard network", has the advantage of not having losses in terms of the theory of microwave circuits given that all the input power—less ohmic losses—is distributed and available to the output ports.

Patent Application US2015/0341098 A1 describes a beamforming network for an antenna array.

As known, the higher the number of antenna elements of an OSA array, the more complex the beamforming network. To this end, it has been observed that the beamforming networks of the known art have relatively increased masses and volumes. This is mainly due to the fact that in order to obtain the 4×4 directional couplers at the basis of the beamforming networks, the use to date has been required of two pairs of 2×2 directional couplers connected to each other in a cascading manner. For this reason, such 4×4 directional couplers are called 4×4 cascade couplers. An example of the aforesaid 2×2 directional couplers is described in the publication "A new class of dual mode directional couplers for compact dual polarization beam-forming networks", F. Alessandri et Al., IEE MICROWAVE AND GUIDED WAVE LETTERS. VOL. 7, NO. 9, SEPTEMBER 1997.

Document U.S. Pat. No. 2,585,173 describes a 4×4 directional waveguide coupler assembled by mutually aligning and coupling four waveguides in which slots were previously made. This directional coupler has relatively high production costs and requires relatively complex assembly operations. Moreover, this coupler is not such as to ensure the isolation between two linear polarizations.

SUMMARY OF THE INVENTION

It is a general object of the present invention to provide an antenna array which has a beamforming network having a reduced mass and small volume with respect to the beamforming networks of the known art.

It is a further object of the present invention to construct a 4×4 directional waveguide coupler which has relatively lower production costs and requires relatively simpler assembly operations as compared to the couplers of the known art, and which is capable of ensuring the isolation between two linear polarizations.

BRIEF DESCRIPTION OF THE DRAWINGS

The invention will be better understood from the following detailed description of embodiments thereof, given by way of example and therefore non-limiting in relation to the accompanying drawings, in which.

DETAILED DESCRIPTION OF THE PREFERRED EMBODIMENTS

Figure 1:
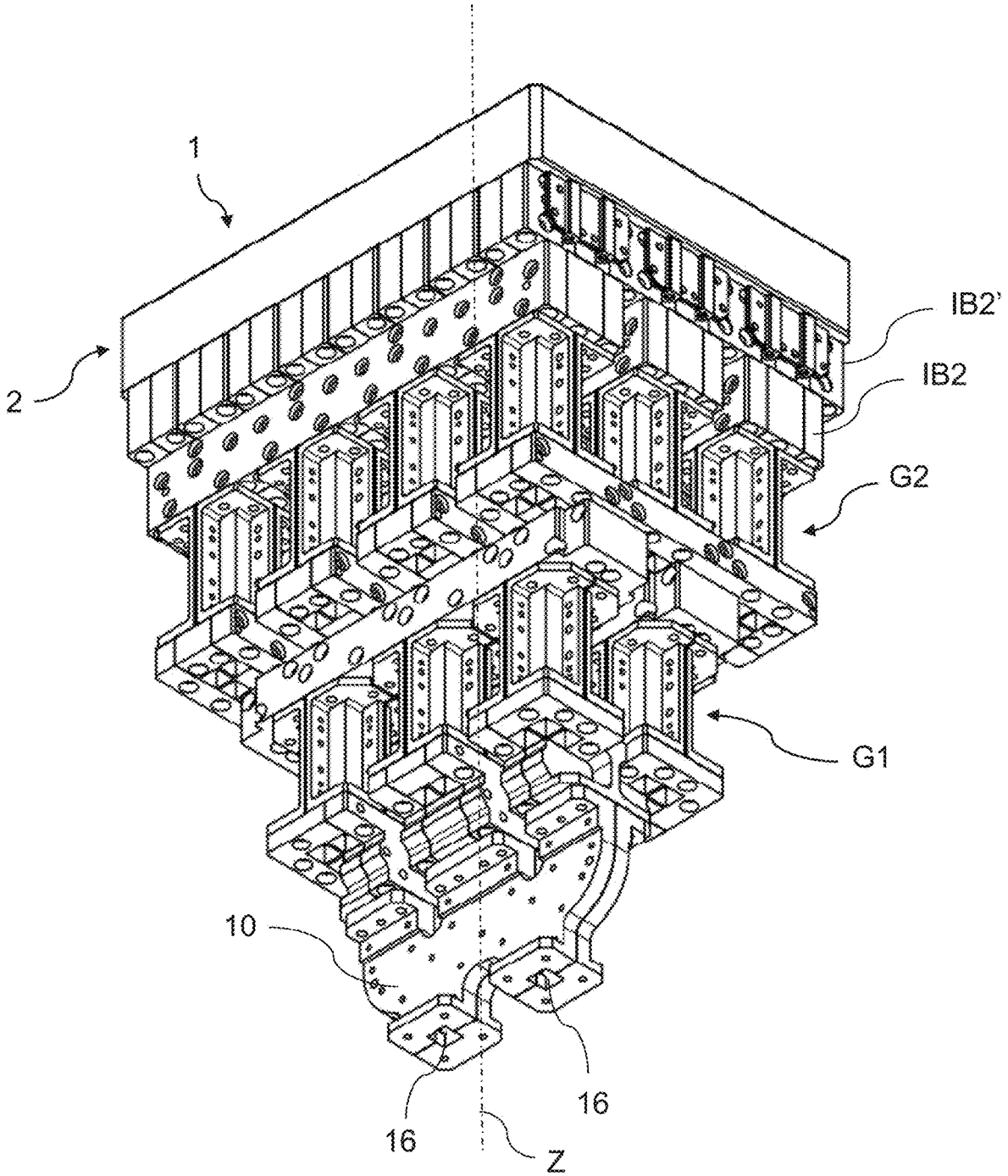
FIG. 1 shows an axonometric view of a non-limiting embodiment of an antenna array, comprising a two-dimensional array of antenna elements and a beamforming network.
Figure 2:
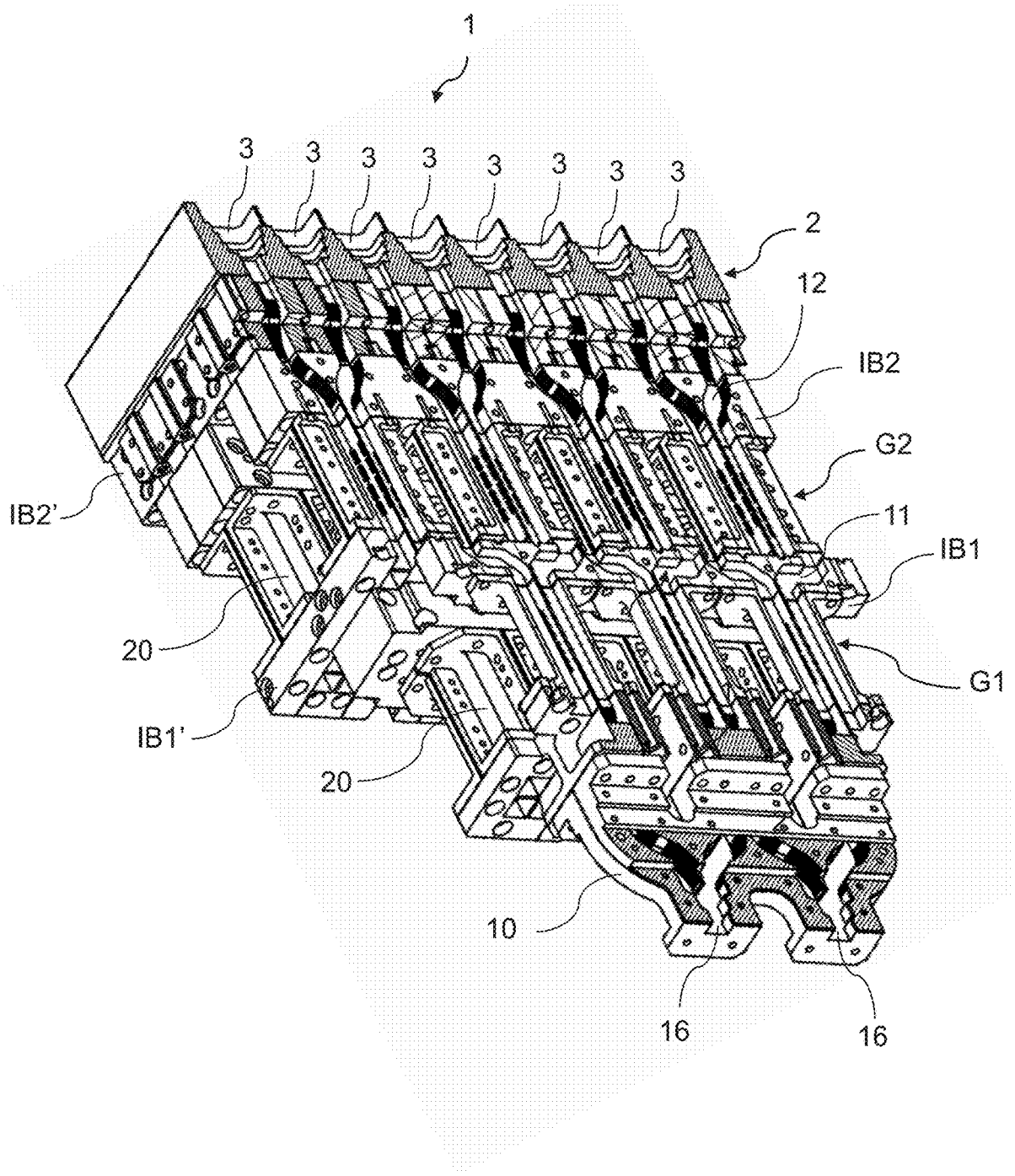
FIG. 2 shows a longitudinal sectional axonometric view of the antenna array in FIG. 1.
Figure 3:
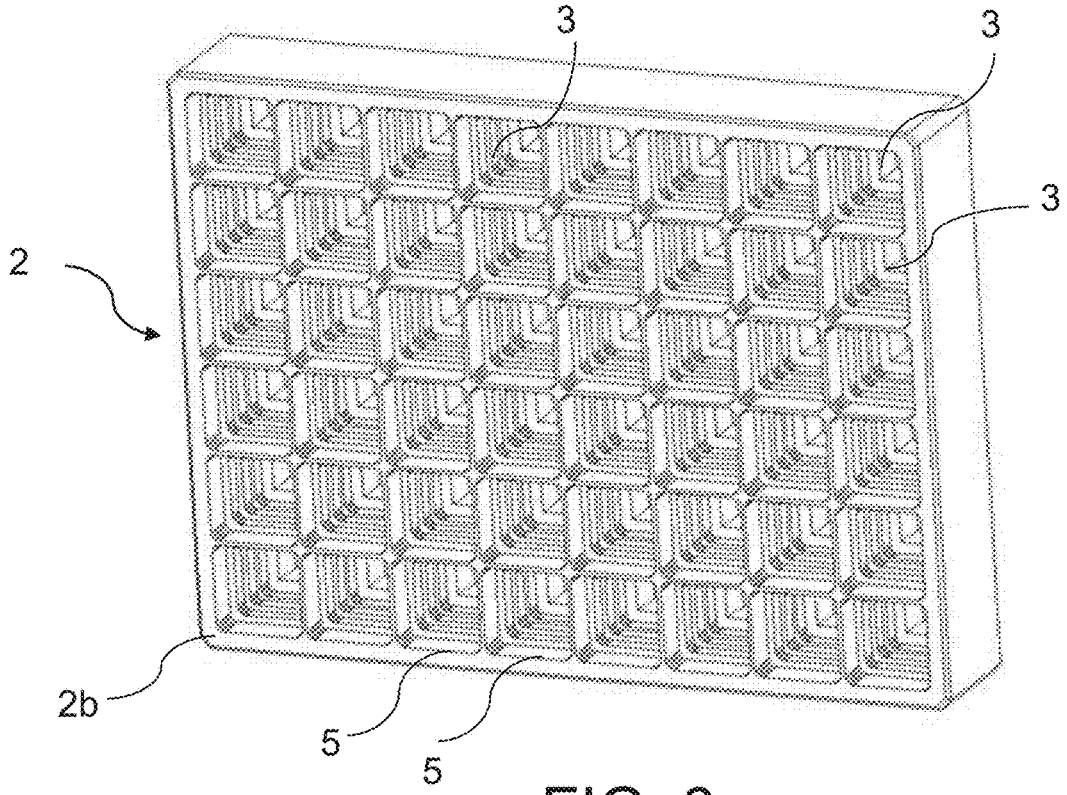
FIG. 3 shows an axonometric view showing the front face of the two-dimensional array of antenna elements of the antenna in FIG. 1.
Figure 4:
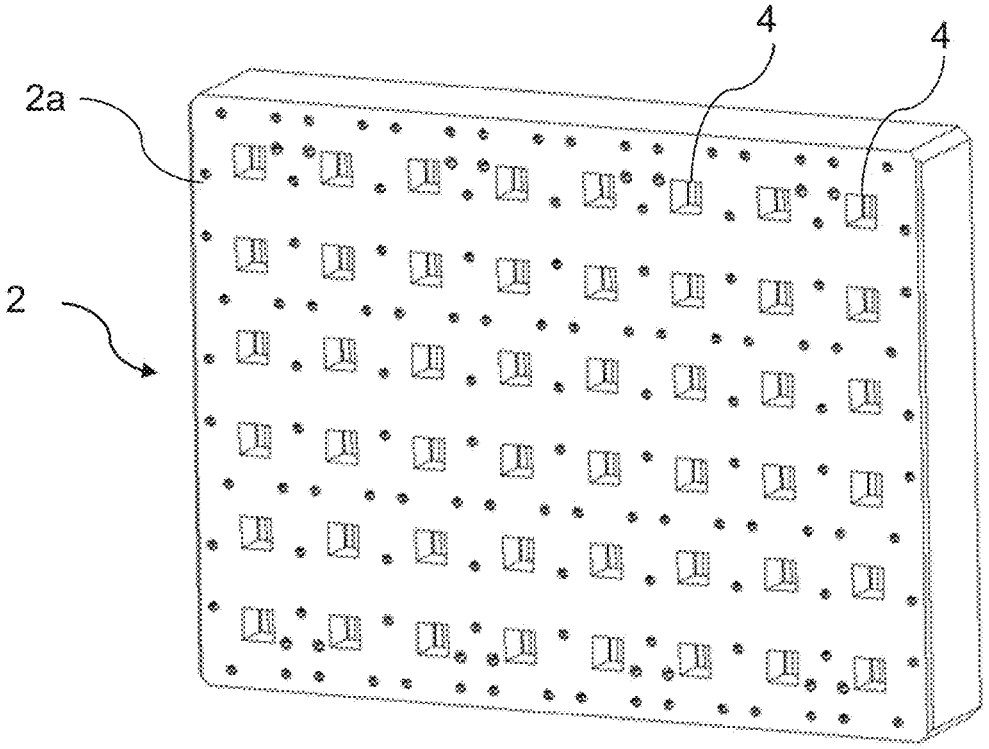
FIG. 4 shows an axonometric view showing the rear face of the two-dimensional array of antenna elements of the antenna in FIG. 1.

Equal or similar elements are indicated with the same numerals in the accompanying figures.

The drawings show an embodiment of an antenna array 1 and of the parts forming it. The aforesaid antenna array 1 preferably is an OSA (Overlapped Subarray Antenna). The antenna array 1 may be a separate antenna or a subarray of a more complex antenna comprising a plurality of subarrays of the type depicted in the accompanying drawings and described below. For example, without any limitation, the antenna array 1 has an operating band equal to 19.7 to 20.2 GHz.

In the particular example depicted in the drawings, the antenna array 1 comprises a two-dimensional array 2 of antenna elements 3. In such an example, the antenna elements 3 are horn elements delimited by a stepped pyramid-shaped inner surface and for this reason are also called stepped horns. According to one embodiment, the two-dimensional array 2 of antenna elements 3 is made by defining a plurality of openings in a block of metal material, e.g. an aluminum block. Such a block of metal material is e.g. a metal plate.

For example, the aforesaid two-dimensional array 2 of antenna elements 3 is a rectangular or square planar array. In the accompanying drawings, such a two-dimensional array 2 is a rectangular array having one side with six antenna elements 3 and one side with eight antenna elements 3, and for this reason has forty-eight antenna elements 3.

For simplicity, reference from now on is made to the case in which the antenna array 1 is a transmitting antenna, therefore to the case in which the antenna elements 3 are radiant elements. However, the teachings of the present description can be easily extended to the case in which the antenna array 1 is a receiving antenna, therefore to the case in which the antenna elements 3 are receiving elements.

The two-dimensional array 2 comprises a first face 2*a* on which the throats, or input ports 4, of the antenna elements 3 are arranged, and an opposite second face 2*b* on which the output mouths 5 of the antenna elements 3 are arranged.

Antenna 1 further comprises a beamforming network G1, G2 comprising a plurality of directional waveguide couplers 20, each having four input ports and four output ports. The aforesaid directional couplers 20 can therefore be defined as 4×4 directional waveguide couplers.

According to an advantageous embodiment, the directional waveguide couplers 20 are dual linear polarization couplers. This implies that the directional couplers 20 are structurally configured so that when the coupling is made, they allow the isolation between the two linear polarizations to be preserved. In other words, they are structurally configured to avoid a mutual coupling between the two linear polarizations.

According to an advantageous embodiment, each directional waveguide coupler 20 comprises four parallel rectangular waveguides W1, W2, W3, W4 which are axially aligned with respect to the longitudinal axis Z1 of the directional coupler 20. Such waveguides W1-W4 are arranged so as to form a matrix having a 2×2 cross section dimension.

The beamforming network G1, G2 preferably comprises a first group G1 of parallel directional waveguide couplers 20. In the example, without any limitation, the first group G1 of directional waveguide couplers 20 is made of six identical or substantially identical 4×4 directional couplers.

The beamforming network G1, G2 preferably further comprises a second group G2 of parallel directional waveguide couplers 20 which are operatively interposed between the directional couplers of the first group G1 and the two-dimensional array 2 of radiant elements 3. In the example shown in the drawings, without any limitation, the second group G2 of directional waveguide couplers is made of twelve identical or substantially identical 4×4 directional couplers. The directional couplers 20 of the first group G1 form a first layer of directional couplers, and the directional couplers 20 of the second group G2 form a second layer of directional couplers. The first and the second groups G1, G2, and therefore also the first and the second layers, are axially spaced apart from one another along the antenna axis Z.

According to an advantageous embodiment, the directional waveguide couplers 20 of the first group G1 are identical to the directional couplers 20 of the second group G2. This certainly results in simplifications in terms of production but it is not essential given that the directional waveguide couplers 20 of the first group G1 in an alternative embodiment are for example, all identical to one another and the same can be said for the directional waveguide couplers 20 of the second group G2, but the directional waveguide couplers 20 of the first group G1 could be different (in length, for example) from the directional waveguide couplers 20 of the second group G2.

The teachings of the present description may be generalized with beamforming networks which also comprise one group alone of directional waveguide couplers, or also more than two groups of directional waveguide couplers, for example three or four groups of directional couplers which form three or four layers of directional couplers, respectively.

Figure 5:
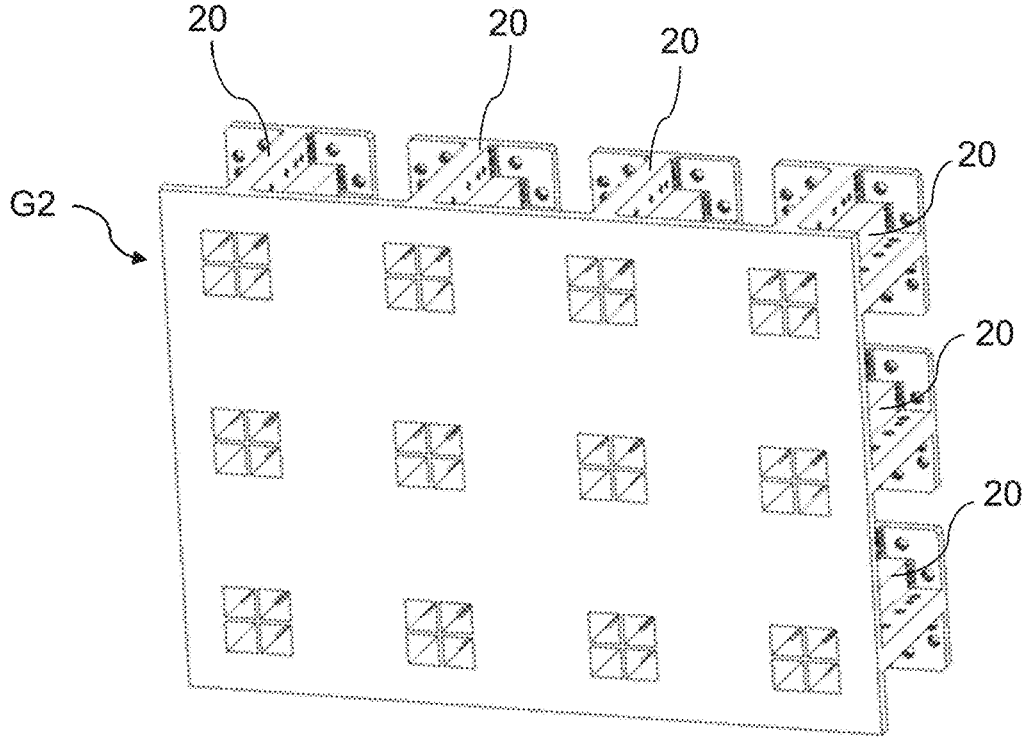
FIG. 5 shows an axonometric view showing the front face of a group of directional waveguide couplers of the beamforming network in FIG. 1.
Figure 6:
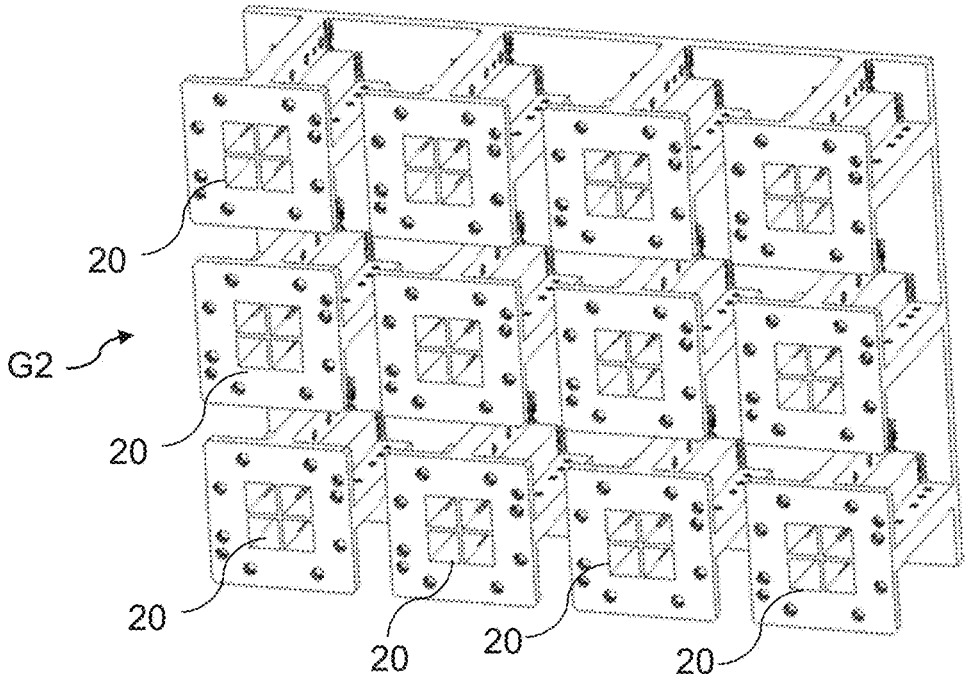
FIG. 6 shows an axonometric view showing the rear face of the group of directional waveguide couplers in FIG. 5.

Moreover, if the beamforming network G1, G2 comprises at least two groups of directional waveguide couplers 20 arranged on two levels, the teachings of the present description may be extended to the general case in which the beamforming network G1, G2 comprises two consecutive groups in which one of the two groups—group G2 in the example—includes a number of directional couplers 20 equal to twice the number of directional couplers 20 of the other group—group G1 in the example. However, this feature is also not limiting given that there is no fixed relation between the number of directional couplers of group G2 and the number of directional couplers of group G1, i.e. between the numbers of directional couplers of two consecutive layers of directional couplers. For example, if a third group of directional couplers is to be added to group G2, on the side opposite to group G1, assuming that group G2 has twelve directional couplers 20 (as shown in FIG. 5, for example), such a third group could have twenty directional couplers 20 to take advantage of all the output ports of the directional couplers of group G2.

At least one of the output ports of each directional coupler 20 of the first group G1 preferably is operatively interconnected by a switching waveguide 11 to at least a respective input port of a directional coupler 20 of the second group G2. Moreover, the same directional coupler 20 of the second group G2 may have at least two input ports which are connected to two output ports, respectively, belonging to different directional couplers of the first group G1. For example, the second group G2 comprises directional couplers 20, each of which being operatively connected to one or two or four different directional couplers of the first group G1.

Figure 10:
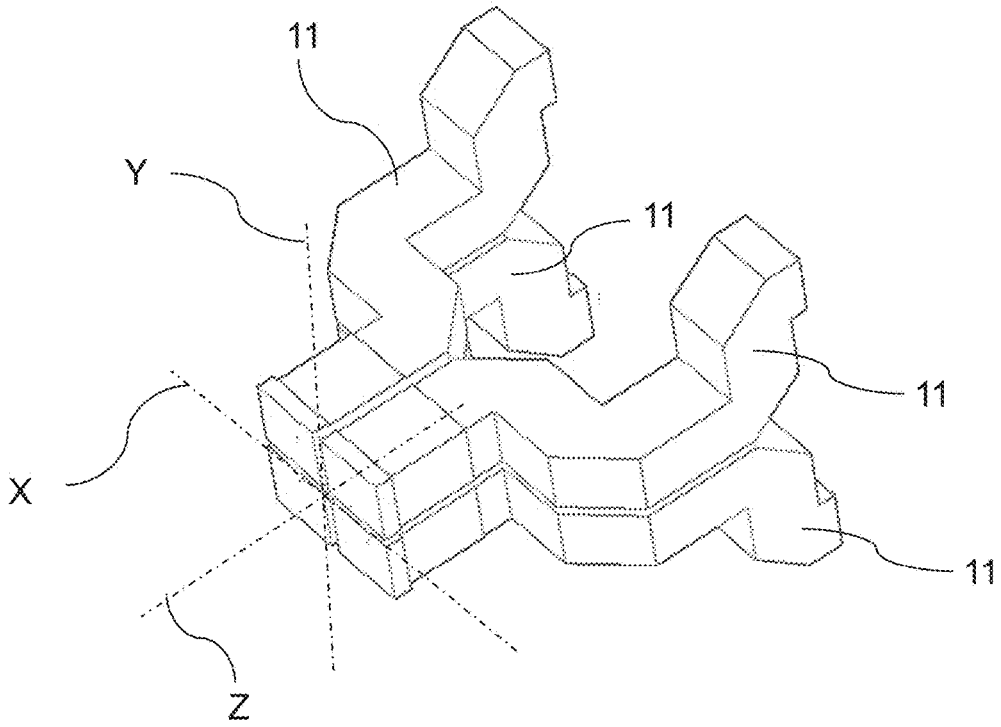
FIG. 10 shows switching waveguides of the antenna array in FIG. 1.

According to a preferred embodiment, the beamforming network G1, G2 further also comprises a first interconnecting block IB1, IB1' which comprises as many switching waveguides 11 as there are output ports of the first group G1 of directional couplers 20. In this example, without any limitation, the first interconnecting block IB1, IB1' comprises twelve switching waveguides 11. FIG. 10 shows four switching waveguides 11. Such switching waveguides 11 are connected to the four output ports of the same 4×4 directional waveguide coupler 20.

Each of the output ports of the directional couplers 20 of the second group G2 preferably is operatively connected by a respective switching waveguide to a respective antenna element 3 of the two-dimensional array 2. In this regard, according to a preferred embodiment, the beamforming network G1, G2 further also comprises a second interconnecting block IB2, IB2' which comprises as many switching waveguides 12 as there are output ports of the second group G2 of directional couplers 20. In this example, without any limitation, the second interconnecting block IB2 comprises forty-eight switching waveguides 12. Such switching waveguides 12 may be similar to the switching waveguides 11 depicted in FIG. 10.

If the switching waveguides 11 of the first interconnecting block IB1, IB1' are such as to require deflecting the propagation axis of the electromagnetic field guided along the two orthogonal directions X, Y as shown in FIG. 10, the first interconnecting block IB1, IB1' advantageously may be divided into two adjacent sub-blocks IB1 and IB1', respectively, in which one of said sub-blocks comprises a first switching waveguide segment along a first direction X and the other of the sub-blocks comprises a second switching waveguide segment along a second direction Y which is perpendicular to the first direction. The aforesaid division facilitates manufacturing the components. The same considerations are valid for the second interconnecting block IB2 and IB2', which similarly may be divided into two adjacent sub-blocks, IB2 and IB2', respectively.

Figure 7:
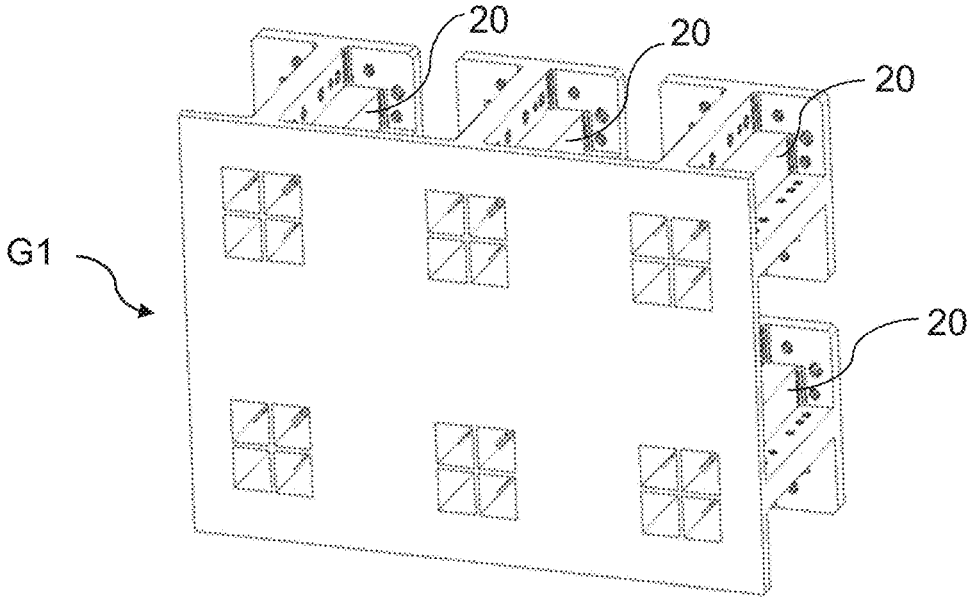
FIG. 7 shows an axonometric view showing the front face of a further group of directional waveguide couplers of the beamforming network in FIG. 1.

According to an advantageous embodiment, the beamforming network G1, G2 further comprises at least one waveguide power divider 10 coupled to the first group G1 of directional waveguide couplers 20. In the example depicted in the drawings, such a power divider 10 is a 2×4 divider and has two input ports 6 and four output ports 16. The four output ports 16 of the power divider 10 are coupled to the eight marked input ports P_I (in FIG. 7) of the directional couplers 20 of the first group G1, which are the innermost input ports in group G1. The input ports 6 may be fed with two equal microwave signals, for example if the antenna array 1 is a DRA—Direct Radiating Array—antenna, or with two different microwave signals, for example if the antenna array 1 is a FAFR—Focus Array Fed Reflector—antenna. Moreover, it is worth noting that the number of the input ports 16 could be different from two, for example equal to one, three or four.

Figure 8:
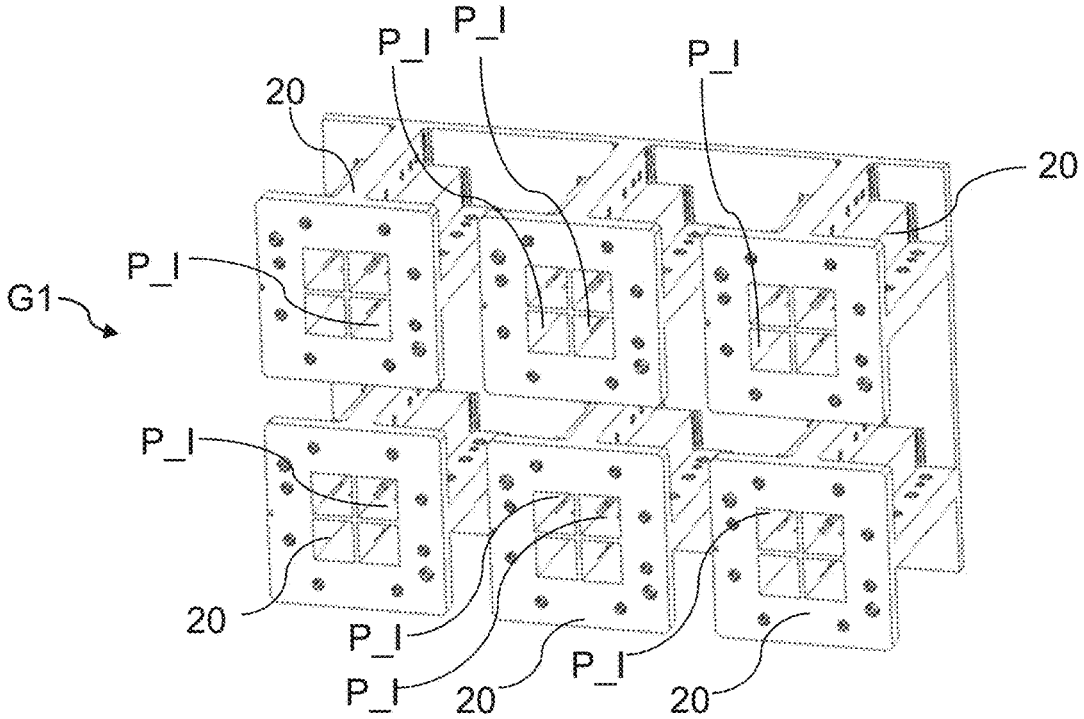
FIG. 8 shows an axonometric view showing the rear face of the group of directional waveguide couplers in FIG. 7.
Figure 9:
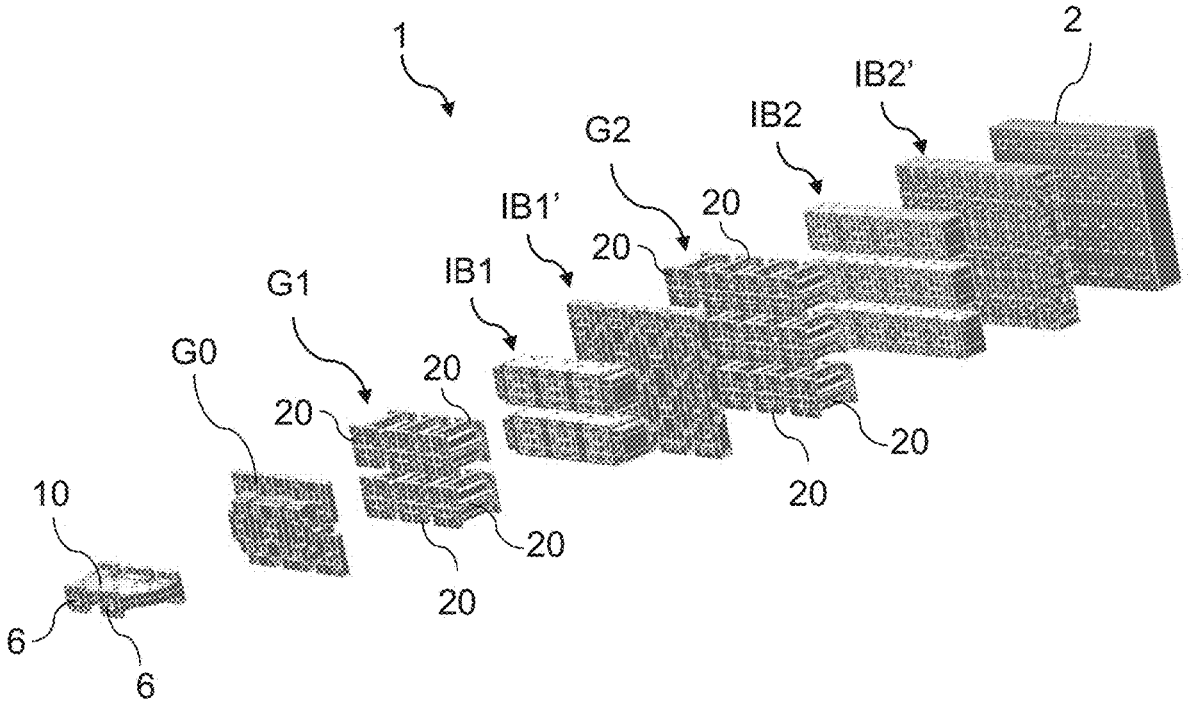
FIG. 9 shows an exploded axonometric view of the antenna array in FIG. 1.

According to a preferred embodiment, the beamforming network G1, G2 further comprises a transition block G0 operatively interposed between the power divider 10 and the first group G1 of directional couplers. Such a transition block G0 contains a plurality of joining waveguides which allow the output ports 16 of the power divider 10 to be connected to the input ports P_I of the directional couplers 20 of the first group G1 of directional couplers. The transition block G0 in the non-limiting example shown in the accompanying drawings comprises a plurality of waveguides provided for operatively connecting the four output ports 16 of the waveguide power divider 10 to the eight inputs of the directional couplers 20 of the first group G1, which are marked with numeral P_I in FIG. 8. In other words, the transition block G0 comprises a system of waveguides adapted to define a 4×8 waveguide power divider.

According to an advantageous embodiment, any unused input ports of the directional waveguide couplers 20 are closed by closing elements, such as for example metal closing plates, or by waveguide loads.

Figure 13:
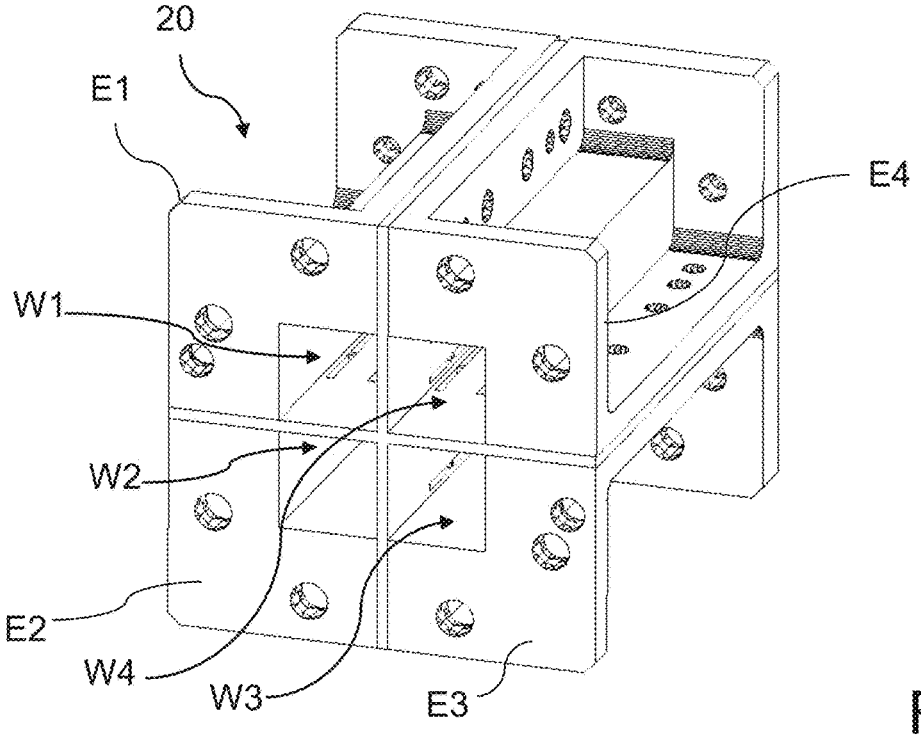
FIG. 13 shows a view of one of the directional waveguide couplers of the groups of couplers in FIGS. 5 to 8.
Figure 14:
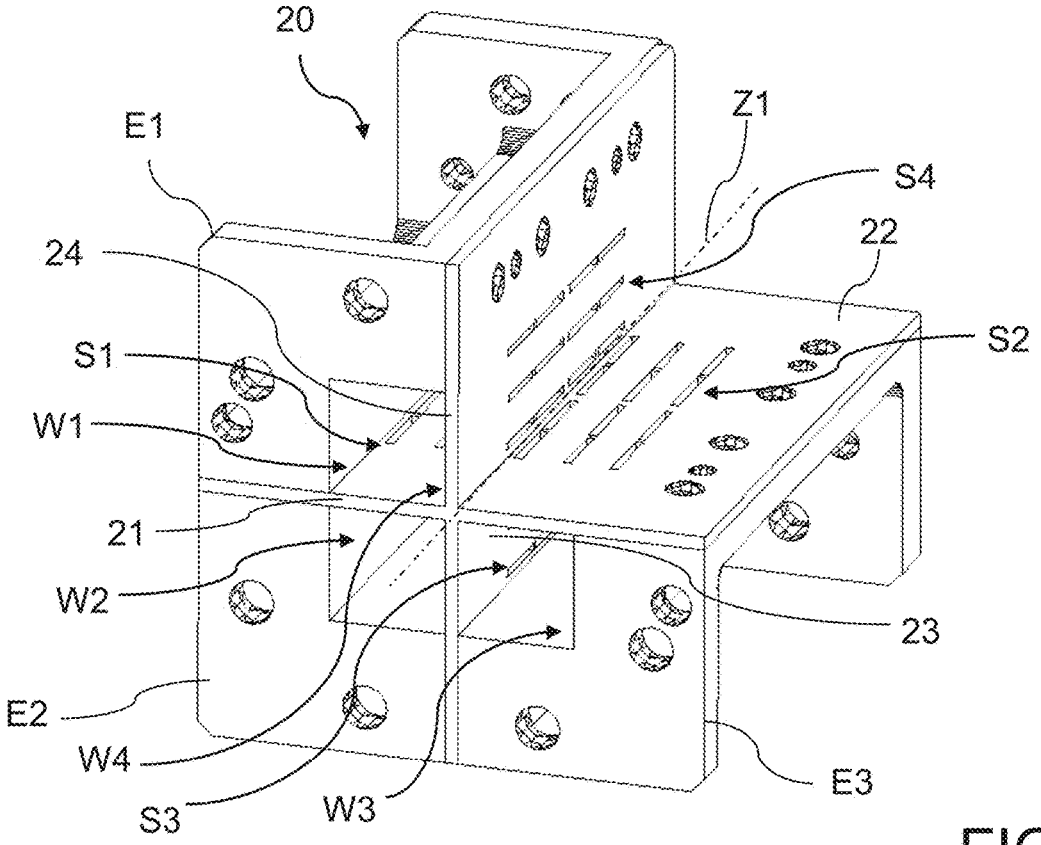
FIG. 14 shows a perspective view of the directional coupler in FIG. 12, from which a part has been removed.

With reference to FIGS. 13 and 14, one of the directional waveguide couplers 20 is described below in greater detail. As already explained, the beamforming network may include a plurality of such directional couplers 20 which may advantageously be identical or substantially identical to one another.

The directional waveguide coupler 20 has four input ports and four output ports, and each of the input ports is coupled to each of the output ports.

The directional coupler 20 comprises a first coupler having two waveguides W1, W2 coupled to each other by a first slot array S1, defined in a first wall common to the two waveguides W1, W2 of the first coupler.

The directional coupler 20 further comprises a second coupler having two waveguides W3, W4 coupled to each other by a second slot array S2, defined in a second wall 22 common to the two waveguides W3, W4 of the second coupler. The first slot array S1 and the second slot array S2 lie on a first common plane, which is the lying plane of the walls 21, 22 in the particular example depicted in the drawings.

The first and second couplers are coupled to each other by a third slot array S3 and a fourth slot array S4, which lie on a second common plane perpendicular to the first common plane.

The waveguides W3 and W4 preferably have two common walls 23, 24. The slot arrays S3 and S4 are defined in such common walls 23, 24, respectively. The two common walls 23 and 24 are coplanar to each other and perpendicular to the two common walls 21 and 22.

More preferably, the third common wall 23 and the fourth common wall 24 are coplanar to each other and perpendicular to the first common wall 21 and to the second common wall 22 so as to form a cross-shaped cross section dividing septum 21, 22, 23, 24 therewith.

According to a particularly advantageous embodiment, each slot of each array S1-S4 extends along a main longitudinal extension axis thereof which is parallel to the main longitudinal extension axis Z1 of the directional coupler. This is a structural feature which advantageously allows the directional coupler 20 to be configured so that it is a directional coupler with dual linear polarization. As explained above, a directional coupler with dual linear polarization is structurally configured so that, when the coupling is made, it allows the isolation between the two linear polarizations to be preserved. In other words, the directional coupler 20 is thus structurally configured to avoid a mutual coupling between the two linear polarizations.

According to an advantageous embodiment, as shown in the example depicted in the accompanying drawings, between the input ports and the output ports of the directional coupler 20, the distance between the waveguides W1, W2, W3, W4 of the directional coupler 20 is constant. In other words, the waveguides W1-W4 are rectilinear and parallel with one another between the output ports and the input ports.

According to an advantageous embodiment, the directional waveguide coupler 20 extends along a main longitudinal extension axis Z1, and the first, second, third and fourth slot arrays are defined on respective portions of said common walls arranged at the same height along said main longitudinal extension axis Z1.

As already explained, according to an advantageous embodiment, the directional coupler 20 is a dual linear polarization coupler. Each of the input ports of the directional waveguide coupler 20 preferably corresponds to two electric ports, one for a vertical polarization signal and the other for a horizontal polarization signal.

The waveguides W1, W2, W3, W4 of the directional coupler 20 preferably are rectangular-section waveguides, e.g. square-section. The square section is another of the structural features which advantageously allows the directional coupler 20 to be configured to be a dual linear polarization coupler.

Figure 11:
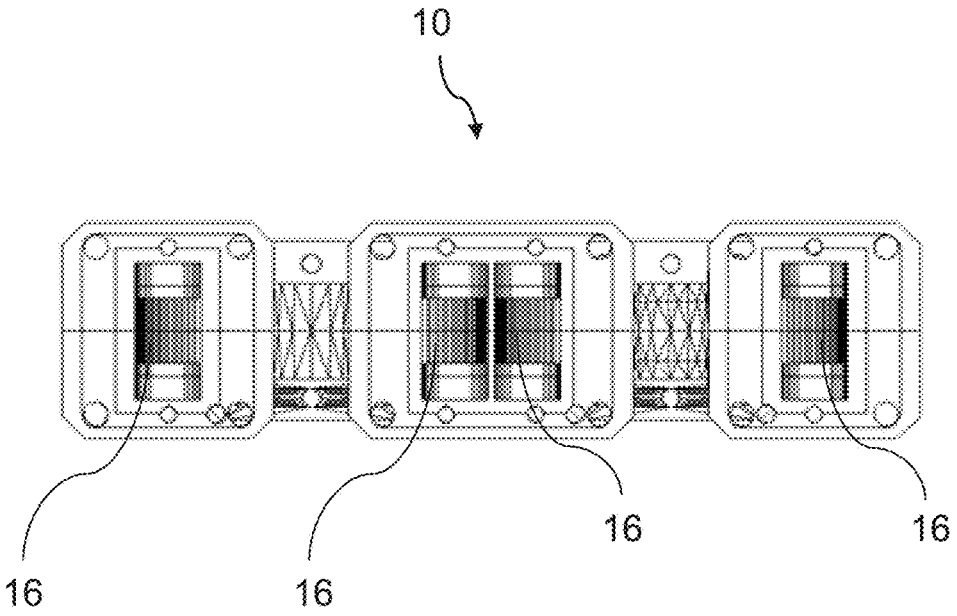
FIG. 11 shows a perspective view of a waveguide power divider of the antenna array in FIG. 1.
Figure 12:
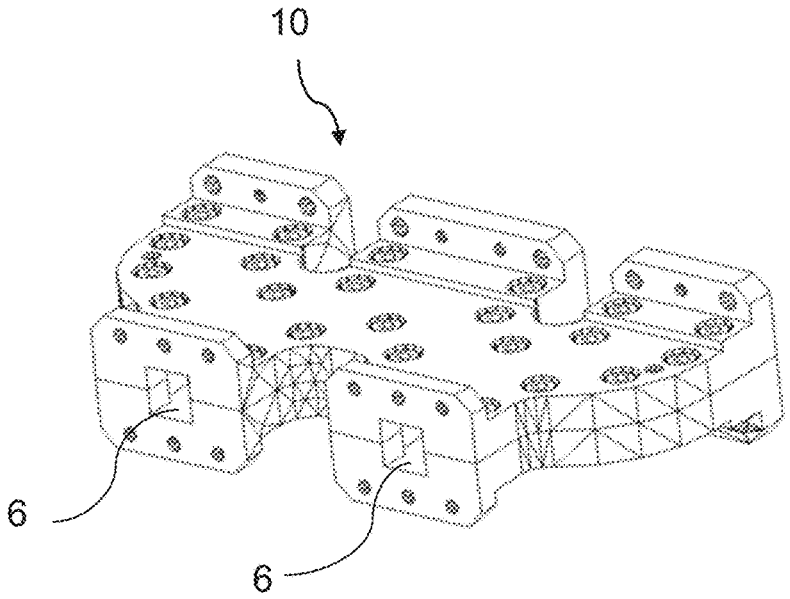
FIG. 12 shows an axonometric view of the waveguide power divider in FIG. 11.

As shown in FIGS. 11 and 12, the waveguides W1, W2, W3, W4 are parallel to one another and arranged on two rows. In other words, they form an array of waveguides with 2×2 dimension.

According to an advantageous embodiment, the directional waveguide coupler 20 extends along a main longitudinal extension axis Z1 and, as shown in FIG. 14, the first S1, second S2, third S3 and fourth S3 slot arrays comprise linear slot arrays having slots which, within the same linear array, are aligned with one another along, or parallel to, said main longitudinal extension axis Z1.

According to an advantageous embodiment, each slot array S1-S4 comprises rectangular slots which have a larger dimension than the other dimension.

According to one embodiment, each slot array S1-S4 is a two-dimensional slot array and comprises a plurality of linear slot arrays. In the example depicted in the drawings, each linear slot array comprises three linear slot arrays. Each linear slot array comprises a number of slots comprised from two to seven and preferably comprises four slots. The increase in the number of slots of each linear array generally increases the flatness of the amplitude and phase distribution and of the operating band, however the loss of the directional coupler increases.

According to one embodiment, the directional coupler 20 comprises a central element with a cross-shaped cross section having the common walls 21-24 and further comprises four angular closing elements E1-E4 fixed, for example by screws, to the central element in order to define the four waveguides W1-W4. It therefore is apparent that the angular closing elements E1-E4 in this embodiment initially form separate pieces from the central element with a cross-shaped cross section which are coupled to the cross-shaped central element when assembling the directional coupler 20. This workaround is particularly advantageous because it allows a directional coupler 20 to be obtained with increased accuracy. For example, the mutual positions between the slots arranged on different common walls are particularly accurate. This workaround also allows the production costs of the directional coupler 20 to be reduced, and also the assembly operations thereof to be simplified.

It is worth noting that while it is convenient for the directional couplers in the same group to be equal to one another, also with regard to the slot arrays S1-S4, directional couplers of various groups may be different from one another, for example also with regard to the slot arrays S1-S4 for example, by differing in the number and/or shape and/or arrangement of the slots.

Figure 15:
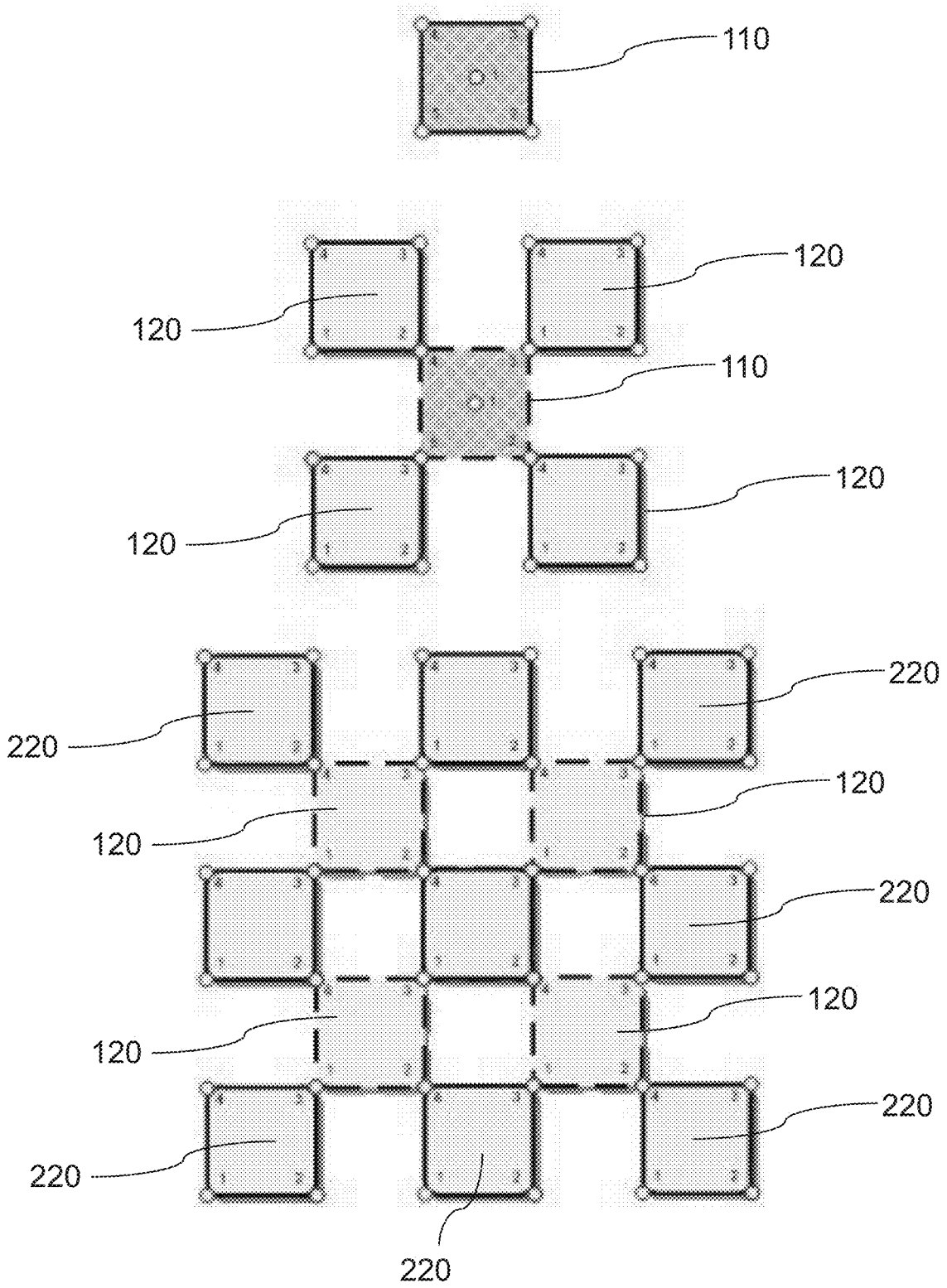
FIG. 15 shows a possible connection diagram between directional couplers of various groups in an antenna similar to the antenna array in FIG. 1.

FIG. 15 shows a connection diagram of an antenna similar to that described above, in which a 1×4 waveguide divider 110 is provided in place of the 2×4 divider. Such a divider has an input port, depicted in the middle of the square, and four output ports, depicted by dots at the corners of the square. The four output ports of divider 110 are each coupled to an input port of four directional couplers 120, which are entirely similar or identical to the directional couplers 20 described above. The four directional couplers 120 are parallel directional couplers and belong to a first group, or layer, of directional couplers. The output ports of the directional couplers 120 of the first group are connected to the input ports of directional couplers 220 belonging to a second group or layer of couplers. Moreover, the directional couplers 220 are entirely similar or identical to the directional couplers 20 described above. An OSA with a checkerboard scheme thereby is achieved. Following the same scheme, any number of additional layers may be added so that the resulting beamforming network feeds a desired or required number of radiant elements 3.

According to the above explanation, it may be understood how a directional waveguide coupler of the type described above allows the above-mentioned objects to be fully achieved with reference to the known art. Indeed, it allows beamforming networks to be made having significantly reduced masses and volumes with respect to the networks of the known art. The reduction factor is about equal to two. It is also worth noting that such a reduction does not introduce any degradation in the radiofrequency performance. A Ka band antenna in particular was made, but the approach can be extended to other frequency bands of interest for spatial applications. Experimental tests have shown that the performance surprisingly is the same or substantially the same as the 4×4 cascade directional couplers of the known art. This was not at all a foregone conclusion, for example due to the fact that while there are two paths of the field between an input port and a diagonal output port in a directional coupler, and that is a first path that goes first from plane E and then from plane H and a second path that goes first from plane H and then from plane E, there is only one path which connects an input port to an output port diagonal thereto in a 4×4 cascade directional coupler of the known art.

The principle of the invention being understood, the embodiments and manufacturing details may largely vary with respect to that described and disclosed by mere way of non-limiting example, without departing from the scope of the invention as defined in the appended claims.

The invention claimed is:

1. A directional waveguide coupler, having four input ports and four output ports, wherein each of the input ports is coupled to each of the output ports, wherein the directional coupler comprises:

a first coupler having two waveguides coupled to each other by a first slot array, defined in a first wall common to the two waveguides of the first coupler;

a second coupler having two waveguides, coupled to each other by a second slot array, defined in a second wall common to the two waveguides of the second coupler;

wherein the first slot array and the second slot array lie on a first common plane;

wherein the first coupler and the second coupler are coupled to each other by a third slot array and a fourth slot array, the third slot array and the fourth slot array lie on a second common plane perpendicular to the first common plane; and wherein each of the input ports of the directional waveguide coupler corresponds to two electric ports, including a first electric port for a vertical polarization signal and a second electric port for a horizontal polarization signal.

2. A directional coupler according to claim 1, wherein said directional coupler is a dual linear polarization coupler structurally configured to preserve isolation between two linear polarizations.

3. A directional coupler according to claim 1, wherein said waveguides are rectangular-section waveguides.

4. A directional coupler according to claim 3, wherein said waveguides are square-section waveguides.

5. A directional coupler according to claim 1, wherein said waveguides between the four input ports and the four output ports are rectilinear and parallel to one another.

6. A directional coupler according to claim 1, wherein said first and said second couplers comprise a third common wall and a fourth common wall on which said third slot array and said fourth slot array are provided.

7. A directional coupler according to claim 6, wherein the third common wall and the fourth common wall are coplanar to each other and perpendicular to the first common wall and to the second common wall, so as to form a cross-shaped section dividing septum therewith.

8. A directional coupler according to claim 1, wherein the directional waveguide coupler extends along a main longitudinal extension axis and wherein the first, second, third and fourth slot arrays comprise linear slot arrays having slots which, within a same linear array, are aligned with one another along, or parallel to, said main longitudinal extension axis.

9. A directional coupler according to claim 6, comprising a central element with a cross-shaped cross section which has the common walls and further comprises four angular closing elements coupled to the central element to define the four waveguides.

10. A directional coupler according to claim 1, wherein the directional waveguide coupler extends along a main longitudinal extension axis, and wherein the first, second, third and fourth slot arrays are defined on respective portions of said common walls arranged at a same height along said axis.

11. A directional coupler according to claim 1, wherein the directional waveguide coupler extends along a main longitudinal extension axis and each slot of each array extends along a main longitudinal extension axis thereof which is parallel to the main longitudinal extension axis of the directional coupler.

12. A beamforming network comprising a plurality of directional waveguide couplers; each of the plurality of directional waveguide couplers comprising:

four input ports and four output ports, wherein each of the input ports is coupled to each of the output ports;

a first coupler having two waveguides coupled to each other by a first slot array, defined in a first wall common to the two waveguides of the first coupler;

a second coupler having two waveguides, coupled to each other by a second slot array, defined in a second wall common to the two waveguides of the second coupler;

wherein the first slot array and the second slot array lie on a first common plane; and wherein the first coupler and the second coupler are coupled to each other by a third slot array and a fourth slot array, the third slot array and the fourth slot array lie on a second common plane perpendicular to the first common plane;

wherein the directional waveguide couplers are arranged in sequence with one another, wherein at least one of the output ports of a previous directional coupler is operatively connected to at least one respective input port of a second directional coupler, which follows said previous directional coupler in said sequence.

13. An antenna array comprising a beamforming network according to claim 12 and a plurality of antenna elements operatively connected to said beamforming network.

14. An antenna array according to claim 13, wherein said plurality of antenna elements forms a two-dimensional array.

15. An antenna array according to claim 13, wherein said antenna is an Overlapped Subarray Antenna (OSA).

* * * * *